US008585198B2

(12) United States Patent
Onishi et al.

(10) Patent No.: US 8,585,198 B2
(45) Date of Patent: Nov. 19, 2013

(54) PRINTING APPARATUS AND PRINTING METHOD

(75) Inventors: Hiroyuki Onishi, Matsumoto (JP); Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 12/857,642

(22) Filed: Aug. 17, 2010

(65) Prior Publication Data

US 2011/0085013 A1 Apr. 14, 2011

(30) Foreign Application Priority Data

Oct. 13, 2009 (JP) ..... 2009-236568

(51) Int. Cl.
*B41J 2/01* (2006.01)
*B41J 29/38* (2006.01)
*B41J 2/155* (2006.01)

(52) U.S. Cl.
USPC ..... 347/102; 347/16; 347/42

(58) Field of Classification Search
None
See application file for complete search history.

(56) References Cited

U.S. PATENT DOCUMENTS

| | | | | |
|---|---|---|---|---|
| 2007/0040885 | A1* | 2/2007 | Kusunoki | 347/102 |
| 2008/0239045 | A1* | 10/2008 | Umebayashi et al. | 347/102 |
| 2009/0086000 | A1* | 4/2009 | Yokota | 347/102 |
| 2009/0244230 | A1* | 10/2009 | Ohnishi et al. | 347/102 |

FOREIGN PATENT DOCUMENTS

| | | |
|---|---|---|
| JP | 2000-158793 | 6/2000 |
| JP | 2005-199563 A | 7/2005 |
| JP | 2006-088529 | 4/2006 |

* cited by examiner

*Primary Examiner* — Stephen Meier
*Assistant Examiner* — Alexander C Witkowski
(74) *Attorney, Agent, or Firm* — Nutter McClennen & Fish LLP

(57) ABSTRACT

A printing apparatus includes: a first nozzle which ejects a first ink used to print an image on a medium and cured by irradiation of light; a pre-curing light source which emits a pre-curing light to dots formed as the first ink ejected from the first nozzle is landed onto the medium; a second nozzle which ejects a second ink used to coat a surface of the medium and cured by irradiation of light onto the medium after being irradiated by the light from the pre-curing light source; and a main-curing light source which emits a main-curing light to the medium, wherein the irradiation energy of the light emitted to a unit area of the medium from the pre-curing light source is changed according to whether the second ink is ejected from the second nozzle.

11 Claims, 9 Drawing Sheets

PRINTING APPARATUS AND PRINTING METHOD

CROSS REFERENCES TO RELATED APPLICATIONS

The present invention contains subject matter related to Japanese Patent Application No. 2009-236568 filed in the Japanese Patent Office on Oct. 13, 2009, the entire contents of which are incorporated herein by reference.

BACKGROUND

1. Technical Field

The present invention relates to a printing apparatus and a printing method.

2. Related Art

There is known a printing apparatus in which printing is performed using a liquid (for example, UV ink) which is cured by the irradiation of light (a kind of electromagnetic wave, for example, ultraviolet light (UV)). In such a printing apparatus, the liquid is ejected onto a medium from the nozzle of a head, and then, the light is emitted to dots formed on the medium. In this way, the dots are cured and fixed on the medium, and thus, it is possible to perform reliable printing even with respect to a medium on which the liquid is difficult to be absorbed. (For example, refer to JP-A-2000-158793.)

Further, as the above described printing apparatus, there has been proposed a printing apparatus in which two-stage curing is performed. For example, as light having low irradiation energy is emitted to dots right after being formed, blurring between inks or diffusion of the dots is restricted (pre-curing). Thereafter, light having a large amount of energy is emitted to the pre-cured dots. Thus, the dots are completely cured (main-curing).

In such a printing apparatus, color dots are formed by ejecting color inks onto a medium, and then, the pre-curing and the main-curing are performed.

In this respect, for example, a surface of an image (color dots after being pre-cured) on the medium may be coated with clear ink during the time after the pre-curing of the color dots and until the main-curing thereof. However, in a case where the coating is performed in this way, there is such a problem that the image quality of the printed image may be different from a case where the coating is not performed.

SUMMARY

An advantage of some aspects of the invention is that it provides a printing apparatus which is capable of achieving a desired image quality regardless of the presence or absence of the coating.

According to an aspect of the present invention, there is provided a printing apparatus including: a first nozzle which ejects a first ink used to print an image on a medium and cured by the irradiation of light; a pre-curing light source which emits a pre-curing light to dots formed as the first ink ejected from the first nozzle is landed onto the medium; a second nozzle which ejects a second ink used to coat the surface of the medium and cured by the irradiation of light onto the medium after being irradiated by the light emitted from the pre-curing light source; and a main-curing light source which emits a main-curing light to the medium, wherein irradiation energy of the light emitted to a unit area of the medium from the pre-curing light source is changed according to whether the second ink is ejected from the second nozzle.

Other aspects of the present invention will become apparent by description below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
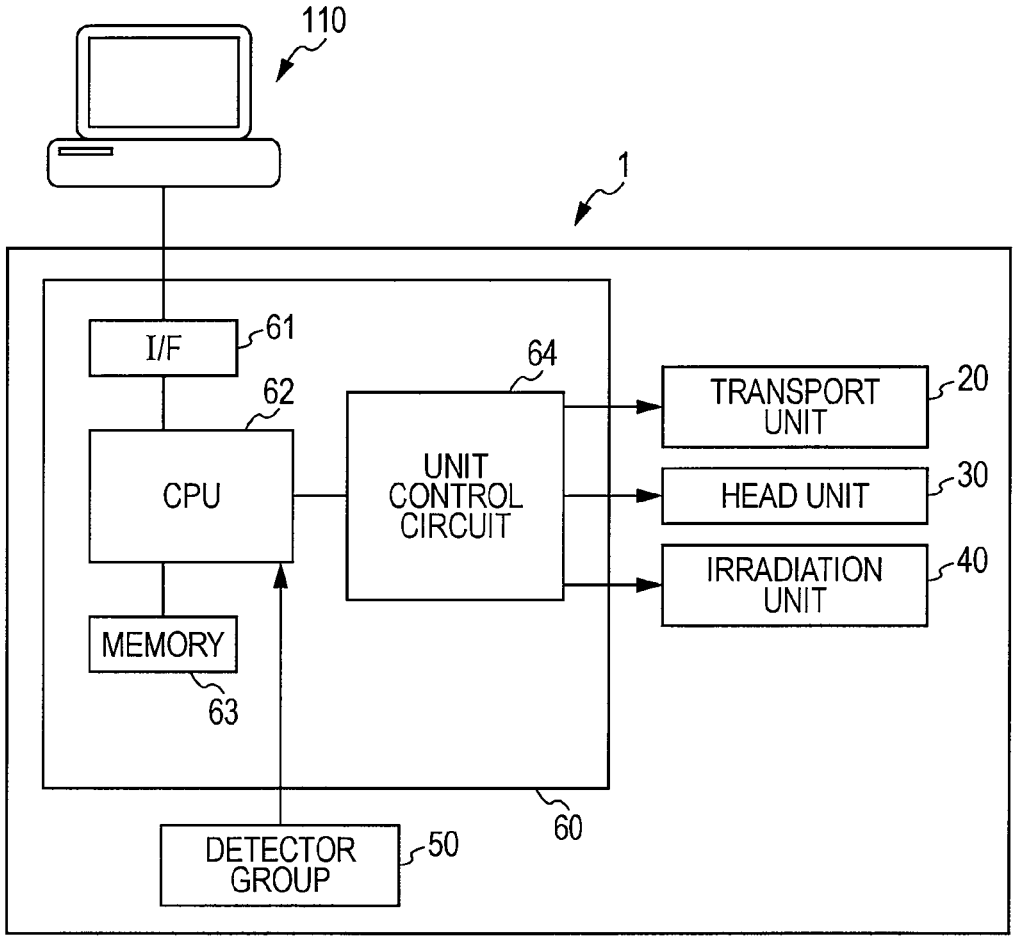
FIG. 1 is a block diagram illustrating a configuration of a printer.

At least the following aspects and advantages will become apparent through the disclosure of this description and the accompanying drawings.

A printing apparatus will become apparent, which includes: a first nozzle which ejects a first ink used to print an image on a medium and cured by the irradiation of light; a pre-curing light source which emits pre-curing light to dots formed as the first ink ejected from the first nozzle is landed onto the medium; a second nozzle which ejects a second ink used to coat the surface of the medium and cured by the irradiation of light onto the medium after being irradiated by the light emitted from the pre-curing light source; and a main-curing light source which emits main-curing light to the medium, wherein the irradiation energy of the light emitted to a unit area of the medium from the pre-curing light source is changed according to whether the second ink is ejected from the second nozzle.

With such a configuration, a desired image quality can be achieved regardless of the presence or absence of a coating.

In the above described printing apparatus, it is preferable that the irradiation energy of the light emitted from the pre-curing light source in a case where the second ink is ejected from the second nozzle is larger than the irradiation energy of the light emitted from the pre-curing light source in a case where the second ink is not ejected from the second nozzle.

With such a configuration, it is possible to restrict blurring between the inks.

In the above described printing apparatus, it is preferable that the first ink includes color inks, the plurality of first nozzles is aligned in the transport direction of the medium for every color of the color inks, and the plurality of pre-curing light sources is installed corresponding to the plurality of first nozzles, respectively.

With such a configuration, since the dots can be pre-cured right after being formed, control of the diameter or blurring of the dots can be reliably performed.

In the above described printing apparatus, the irradiation energy of the light from each pre-curing light source may be changed according to whether the second ink is ejected from the second nozzle.

With such a configuration, it is possible to restrict blurring between the inks.

In the above described printing apparatus, the irradiation energy of the light from the pre-curing light source corresponding to the first nozzle located on the most downstream side in the transport direction may be changed according to whether the second ink is ejected from the second nozzle.

With such a configuration, it is possible to efficiently restrict blurring between the inks.

In the above described printing apparatus, the irradiation energy of the light from the pre-curing light source corresponding to a predetermined first nozzle may be changed according to whether the second ink is ejected from the second nozzle.

With such a configuration, it is possible to efficiently restrict blurring between the inks.

In the above described printing apparatus, the second ink may be a clear ink.

With such a configuration, the image quality can be adjusted according to whether the coating is performed by the clear ink.

In the above described printing apparatus, the second ink may be a background ink for printing a background image of the image.

With such a configuration, the image quality can be adjusted according to whether the background image is printed on the color image.

First Embodiment

In the first embodiment, a line printer (printer 1) will be described as an example of a printing apparatus.

Configuration of Printer

Figure 2:
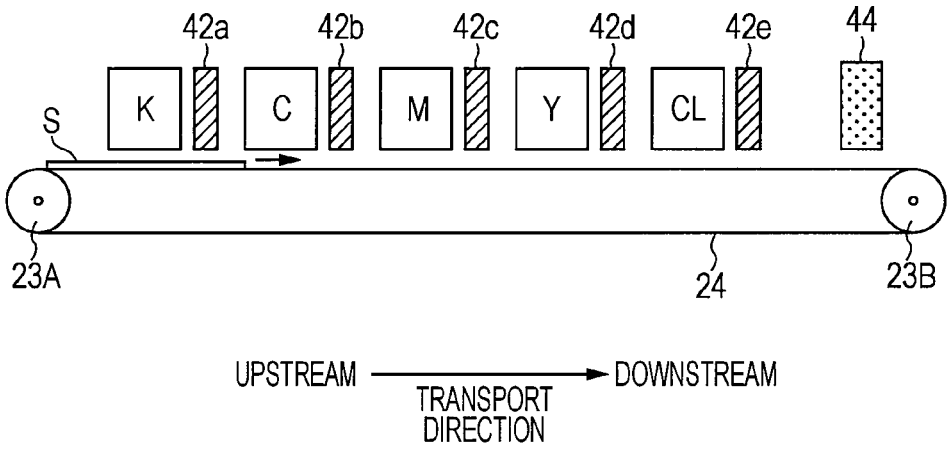
FIG. 2 is a schematic diagram illustrating a periphery of a printing region.

FIG. 1 is a block diagram illustrating an entire configuration of the printer 1, and FIG. 2 is a schematic diagram illustrating a periphery of a printing region.

The printer 1 is a printing apparatus which prints an image on a medium such as a sheet of paper, fabric or film, and is connected to a computer 110 which is an external apparatus to be able to communicate therewith.

A printer driver is installed in the computer 110. The printer driver is a program used for displaying a user interface on a display device (not shown) and for converting image data output from an application program into printing data. The printer driver is recorded in a recording medium (computer readable recording medium) such as a flexible disc FD or a CD-ROM. Alternatively, the printer driver can be downloaded to the computer 110 through the Internet. The program is made of codes for realizing a variety of functions.

Further, the computer 110 outputs printing data corresponding to an image to be printed in order to print the image in the printer 1.

Here, the "printing apparatus" represents an apparatus for printing an image on a medium, and for example, the printer 1 corresponds to the printing apparatus. Further, a "printing control apparatus" represents an apparatus for controlling the printing apparatus, and for example, the computer 110 in which the printer driver is installed corresponds to the printing control apparatus.

The printer 1 according to the present embodiment is an apparatus for printing an image on a medium by ejecting ultraviolet curable ink (hereinafter, referred to as "UV ink") as an example of a liquid cured by the irradiation of ultraviolet light (hereinafter, referred to as "UV"). The UV ink includes ultraviolet cured resin, and is cured by a light polymerizing reaction in the ultraviolet cured resin in reception of the irradiation of the UV. The printer 1 according to the present embodiment uses four colors of UV inks (color inks) C, M, Y and K for printing an image, and a colorless and transparent UV ink (clear ink). In the present embodiment, the color inks correspond to a first ink, and the clear ink corresponds to a second ink.

The printer 1 according to the present embodiment includes a transport unit 20, a head unit 30, an irradiation unit 40, a detector group 50 and a controller 60. The printer 1 which receives printing data from the computer 110 which is the external apparatus controls the respective units (the transport unit 20, the head unit 30 and the irradiation unit 40) by the controller 60 so as to print an image on the medium in accordance with the printing data. The controller 60 controls the respective units to print the image on the medium, on the basis of the printing data received from the computer 110. The situation in the printer 1 is monitored by the detector group 50, and the detector group 50 outputs the detection result to the controller 60. The controller 60 controls the respective units on the basis of the detection result output from the detector group 50.

The transport unit 20 transports the medium (for example, a sheet of paper S or the like) in a predetermined direction (hereinafter, referred to as the "transport direction"). The transport unit 20 includes an upstream transport roller 23A, a downstream transport roller 23B and a belt 24. If a transport motor (not shown) rotates, the upstream transport roller 23A and the downstream transport roller 23B rotate, and the belt 24 also rotates. The medium supplied by a paper feed roller (not shown) is transported to a printable region (a region facing the head) by the belt 24. As the belt 24 transports the medium, the medium is moved in the transport direction with respect to the head unit 30. The medium passing through the printable region is discharged to the outside by the belt 24. Further, the medium which is being transported is electrostatically adsorbed or vacuum-adsorbed to the belt 24.

The head unit 30 is configured to eject the UV ink onto the medium. The head unit 30 forms dots on the medium so as to print the image on the medium by ejecting the ink from each head to the medium which is being transported. As described above, in the present embodiment, the color inks for printing the image and the colorless and transparent clear ink are used as the UV ink. The printer 1 according to the present embodiment is a line printer, and the respective heads of the head unit 30 can form dots corresponding to the width of the medium at one time. As shown in FIG. 2, the respective heads including a black ink head K for ejecting a black UV ink, a cyan ink head C for ejecting a cyan UV ink, a magenta ink head M for ejecting a magenta UV ink, a yellow ink head Y for ejecting a yellow UV ink and a clear ink head CL for ejecting the clear ink are installed in a sequential manner from the upstream side of the transport direction. In the following description, the respective heads for ejecting the color inks (black, cyan, magenta, and yellow) are referred to as "color ink heads". Further, the dots formed by the color inks ejected from the color ink heads are referred to as "color dots", and the dots formed by the clear ink ejected from the clear ink head CL are referred to as "clear dots".

A configuration of the head unit 30 will be described in detail hereinafter.

The irradiation unit 40 emits the UV toward the UV ink landed on the medium. The dots formed on the medium are irradiated by the UV from the irradiation unit 40 to be cured. The irradiation unit 40 according to the present embodiment includes pre-curing irradiation sections 42*a* to 42*e*, and a main-curing irradiation section 44.

The pre-curing irradiation sections 42*a* to 42*e* emit the UV for pre-curing the dots formed on the medium. The pre-curing irradiation section 42*a* is installed on the downstream side of the black ink head K in the transport direction, and the pre-curing irradiation section 42*b* is installed on the downstream side of the cyan ink head C in the transport direction. Further, the pre-curing irradiation section 42*c* is installed on the downstream side of the magenta ink head M in the transport direction, and the pre-curing irradiation section 42*d* is installed on the downstream side of the yellow ink head Y in the transport direction. Further, the pre-curing irradiation section 42*e* is installed on the downstream side of the clear ink head CL in the transport direction.

The lengths of the pre-curing irradiation sections 42*a* to 42*e* in a width direction of the medium are equal to or larger than the width of the medium, and the UV light for the pre-curing can be emitted onto the dots formed on the medium by the respective heads. In this embodiment, the pre-curing refers to a curing which is performed for suppressing blurring between inks or diffusion of the dots.

The pre-curing irradiation sections 42*a* to 42*e* according to the present embodiment include a light emitting diode (LED) as a light source for the UV irradiation. The LED controls the magnitude of input electric current, to thereby easily change the irradiation energy. Further, details of the pre-curing will be described hereinafter.

The main-curing irradiation section 44 is used for irradiation of the UV for main-curing the dots formed on the medium by the respective heads, and is installed on the downstream side in the transport direction with respect to the pre-curing irradiation section 42*e*. Further, the length of the main-curing irradiation section 44 in the width direction of the medium is equal to or larger than the width of the medium. In this embodiment, the main-curing is a curing which is performed for completely curing the dots.

The main-curing irradiation section 44 according to the present embodiment includes a lamp (metal halide lamp, mercury lamp or the like) as the light source of the UV irradiation.

Hereinafter, details of the main-curing will be described.

The detector group 50 includes a rotary encoder (not shown), a paper detection sensor (not shown), and so on. The rotary encoder detects the rotation amount of the upstream transport roller 23A or the downstream transport roller 23B. On the basis of the detection result of the rotary encoder, the transport amount of the medium can be detected. The paper detection sensor detects the position of a leading edge of the medium which is being fed.

The controller 60 is a control unit (control section) for controlling the printer. The controller 60 includes an interface section 61, a CPU 62, a memory 63 and a unit control circuit 64. The interface section 61 performs transmission and reception of data between the computer 110 which is the external apparatus and the printer 1. The CPU 62 is an arithmetic processing unit for controlling the entire printer. The memory 63 is used for securing a region for storing programs of the CPU 62, a work region or the like, and includes a storage element such as a RAM or EEPROM. The CPU 62 controls the respective units through the unit control circuit 64 according to the program stored in the memory 63.

Printing Operation

If the printer 1 receives the printing data from the computer 110, the controller 60 firstly rotates a paper feed roller (not shown) by the transport unit 20 and transports the medium to be printed (for example, a sheet of paper S) on the belt 24. The medium is transported at a constant speed on the belt 24 without stopping, and passes under the head unit 30 and the irradiation unit 40. At this time, the ink is intermittently ejected from the nozzle of each head of the head unit 30 to thereby form dots on the medium, and the UV is emitted from the respective irradiation sections of the irradiation unit 40. In this way, an image is printed on the medium. Finally, the controller 60 allows the medium after completion of the image printing to be discharged.

Configuration of Head

The printer 1 according to the present embodiment includes the above described four color ink heads (the black ink head K, the cyan ink head C, the magenta ink head M, and the yellow ink head Y), and the clear ink head CL.

The color ink heads eject the UV ink (color ink) for the image printing for every ink color.

The clear ink head CL ejects (applies) the colorless and transparent clear ink onto an entire surface of the medium. Further, in this embodiment, the clear ink is used for coating the surface of the medium.

Figure 3:
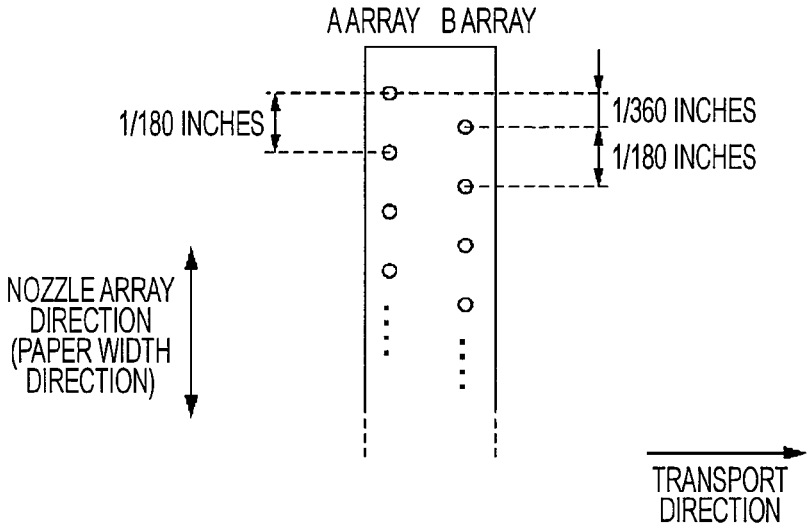
FIG. 3 is a diagram illustrating a nozzle arrangement of each head.

FIG. 3 is a diagram illustrating an example of a nozzle arrangement of each head.

As shown in the figure, each head includes two nozzle arrays of an "A array" and a "B array".

The nozzles in each array are aligned with an interval (nozzle pitch) of 1/180 inches along a direction (nozzle array direction) intersecting with the transport direction. Further, positions of the nozzles in the A array in the nozzle array direction and positions of the nozzles in the B array in the nozzle array direction are shifted by the amount of a half nozzle pitch (1/360 inches). Thus, color dots or clear dots can be formed at a resolution of 1/360 inches.

Further, the length of each nozzle array in the nozzle array direction (paper width direction) is equal to or larger than the length of the medium width, and thus, dots corresponding to the amount of the medium width can be formed at one time.

Pre-Curing and Main-Curing

The printer 1 according to the present embodiment includes the pre-curing irradiation sections 42*a* to 42*e* and the main-curing irradiation section 44 as the irradiation unit 40, and performs two-stage curing of the pre-curing and the main-curing after forming the dots. Hereinafter, functions of the respective curing processes will be described.

The pre-curing is a curing for restricting blurring between inks and diffusion of dots by curing only a surface of the dots. In this pre-curing process, the irradiation energy of the UV emitted to a unit area of the medium (hereinafter, simply referred to as "irradiation energy") is small, and thus, the UV ink (dots) is not completely cured after the pre-curing. Further, the irradiation energy (mJ/cm$^2$) is a product of irradiation intensity (mW/cm$^2$) and irradiation time (sec). In this embodiment, the transport speed of the medium is constant (the irradiation time by the respective irradiation sections is constant). Accordingly, the irradiation energy of the UV depends on the irradiation intensity.

Figure 4A:
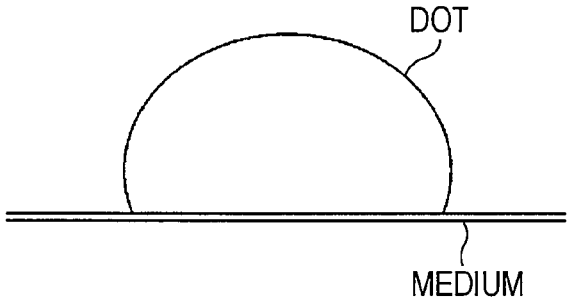
FIG. 4A is a diagram illustrating a relationship between an irradiation amount of UV and a shape of UV ink (dots) in a pre-curing process.
Figure 4B:
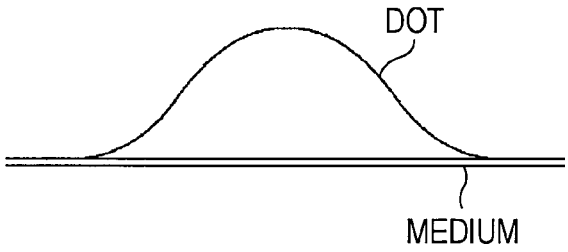
FIG. 4B is a diagram illustrating a relationship between an irradiation amount of UV and a shape of UV ink (dots) in a pre-curing process.
Figure 4C:
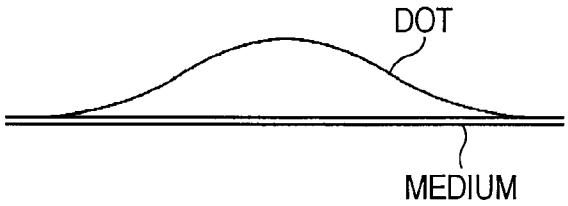
FIG. 4C is a diagram illustrating a relationship between an irradiation amount of UV and a shape of UV ink (dots) in a pre-curing process.

FIGS. 4A to 4C are diagrams illustrating the relationship between the irradiation energy of the UV and the shape of the UV ink (dots) in the pre-curing. Further, the irradiation energy of the UV becomes decreased in the order of FIGS. 4A, 4B and 4C.

In a case where the irradiation energy of the UV is large, for example, as in the case of FIG. 4A, blurring between inks and diffusion of dots can be restricted. However, the unevenness of the surface of the medium, which is generated by the dots, is increased, thereby deteriorating the glazing.

On the other hand, in a case where the irradiation energy of the UV is small, for example, as in the case of FIG. 4C, glazing becomes reliable. Here, blurring is likely to occur between other inks.

The main-curing is a curing for completely curing the ink. The irradiation energy of the UV in the main-curing is larger than the irradiation energy of the UV in the pre-curing. Specifically, the UV irradiation energy in the main-curing is 200 to 500 mJ/cm$^2$, whereas the UV irradiation energy in the pre-curing is 3 to 30 mJ/cm$^2$ (preferably, 5 to 15 mJ/cm$^2$).

Coating

Figure 5:
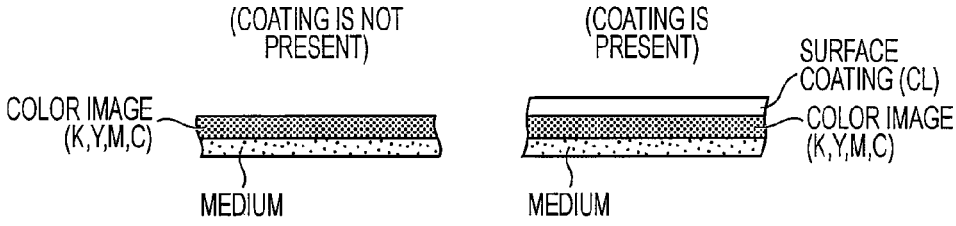
FIG. 5 is a diagram illustrating images which are respectively printed in a case where a coating is present and in a case where a coating is not present.

FIG. 5 is a diagram illustrating images which are respectively printed in a case where the coating is present and a case where the coating is not present.

In the case where the coating is not present, a color image by the four colors of color inks (K, C, M and Y) is formed on the medium.

Firstly, the black ink is ejected from the black ink head K at the time when the medium passes under the black ink head K. Accordingly, the dots are formed on the medium. Then, when the medium passes under the pre-curing irradiation section 42*a*, the pre-curing UV is emitted from the pre-curing irradiation section 42*a*, and the dots formed by the black ink head K are pre-cured. In a similar way, with respect to the cyan, magenta and yellow inks, the dot formation and the pre-curing UV irradiation are performed. In this way, the color image by the four colors of color inks (K, C, M and Y) is printed on the medium. Finally, the main-curing UV is emitted from the main-curing irradiation section 44, and thus, the dots on the medium are completely cured.

On the other hand, in the case where the coating is present, the color image by four colors of the color ink (K, C, M and Y) is formed on the medium, and then, a surface coating layer by the clear ink is formed thereon.

This case is the same as in the case where the coating is not present until the color image is formed. In the case where the coating is present, the clear ink is applied on the color image from the clear ink head CL between the formation of the color image and the main-curing. Thus, a surface coating layer is formed on the color image by the clear ink. Then, the pre-curing UV is emitted onto the surface coating layer from the pre-curing irradiation section 42*e*. Thus, the surface coating layer is pre-cured. Further, the UV irradiation energy emitted from the pre-curing irradiation section 42*e* may be smaller than the UV irradiation energy emitted from the other pre-curing irradiation sections 42*a* to 42*d*. Alternatively, the pre-curing UV may not be emitted from the pre-curing irradiation section 42*e*. In this way, as the pre-curing UV emitted onto the clear ink becomes small, the surface of the surface coating layer can be smoothed, to thereby improve glazing thereof. Finally, the main-curing UV is emitted from the main-curing irradiation section 44, and thus, the dots on the medium are completely cured.

As described above, since the pre-curing is a curing for restricting blurring between the inks and diffusion of dots, the dots after the pre-curing are not completely cured.

Accordingly, in the case where the coating is present, the clear ink is ejected (applied) on the color dots (color inks) which are not completely cured, and thus, blurring is likely to occur between the color inks and the clear ink.

In this embodiment, after forming the color image, in the case where the coating is performed and in the case where the coating is not performed, the irradiation energy of the pre-curing UV to the color dots is changed. In the present embodiment, the irradiation energy of the pre-curing UV to the color dots becomes large in the case where the coating is performed (in a case where the clear ink is ejected later), compared with the case where the coating is not performed (in a case where the clear ink is not ejected later). Thus, even though the coating is performed on the color image, blurring can be restricted in a similar way to the case where the coating is not performed.

Here, in this case, with respect to the color dots after the pre-curing, in the case where the coating is present (UV irradiation energy is large), the unevenness of the dots increases, compared with the case where the coating is not present (UV irradiation energy is small) (see FIG. 4). That is, in the case where the coating is present, the glazing of the color image deteriorats. However, in this embodiment, in the case where the unevenness of the color dots is large, the clear ink is applied to perform the coating, and thus, the glazing can be enhanced. Accordingly, the deterioration of the glazing of the color image as the unevenness of the color dots becomes large can be restricted.

Energy Setting for Pre-Curing

Figure 6:
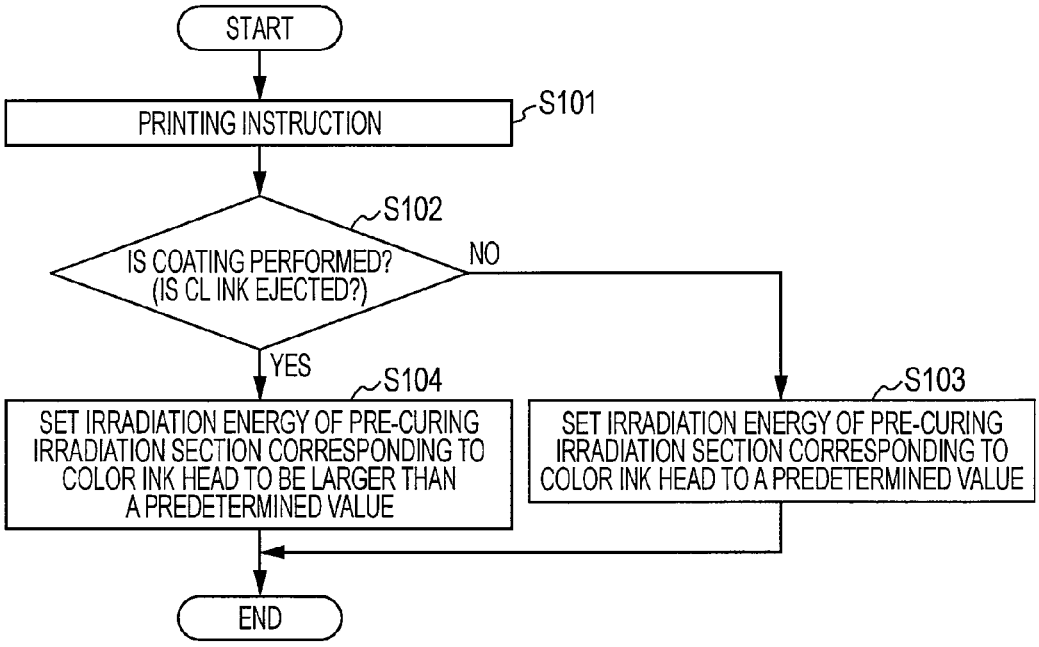
FIG. 6 is a flowchart illustrating UV irradiation energy setting of pre-curing according to a first embodiment of the invention.

FIG. 6 is a flowchart illustrating UV irradiation energy setting for pre-curing according to a first embodiment.

Firstly, the controller 60 determines whether the coating is to be performed (that is, whether the ink is to be ejected from the clear ink head CL) (S102), if the controller 60 receives a printing instruction from the computer 110 (S101). In a case where it is determined that the coating is not to be performed (in a case where the clear ink is not to be ejected from the clear ink head CL) ("NO" in S102), the UV irradiation energies of the pre-curing irradiation sections 42*a* to 42*d* corresponding to the color ink heads (the black ink head K, the cyan ink head C, the magenta ink head M and the yellow ink head Y) are set to a predetermined value, respectively (S103).

On the other hand, in a case where it is determined that the coating is to be performed (in a case where the clear ink is ejected from the clear ink head CL) ("YES" in S102), the UV irradiation energies of the pre-curing irradiation sections 42*a* to 42*d* corresponding to the color ink heads are set to be larger than the predetermined value, respectively (S104). In other words, an input electric current to the respective light sources (LED) of the pre-curing irradiation sections 42*a* to 42*d* is set to be larger than an input electric current in the case where the coating is not performed.

In this way, in this embodiment, according to whether the coating is to be performed after forming the color images by the color inks, the UV irradiation energies of the pre-curing of the pre-curing irradiation sections 42*a* to 42*d* respectively corresponding to the color ink heads are changed. Specifically, the UV irradiation energies of the pre-curing irradiation sections 42*a* to 42*d* in the case where the coating is present is set to be larger than the irradiation energies in the case where the coating is not present. In this way, even though the coating is performed after the color dots are formed, blurring between the color inks and the clear ink can be restricted.

First Modified Example of the First Embodiment

In the above described embodiment, according to whether the coating is to be performed, the UV irradiation energies of the pre-curing irradiation sections 42*a* to 42*d* corresponding to the color ink heads are respectively changed, but only the UV irradiation energy of the pre-curing irradiation section 42*d* corresponding to the head located on the most downstream side in the transport direction among the color ink heads (the yellow head Y in the case of FIG. 2) may be changed.

This is because if the pre-curing irradiation energy of only the pre-curing irradiation section 42*a* becomes large, only the dots formed by the black ink head K undergo UV irradiation. In this case, since the dots formed by the respective heads of the cyan ink head C, the magenta ink head M and the yellow ink head Y undergo UV irradiation of a normal energy (a predetermined value), there is a risk that blurring with respect to the clear ink occurs by performing the coating. On the other hand, if the pre-curing irradiation energy of the pre-curing irradiation section 42*d* is increased, UV of this energy level can be emitted onto the dots formed by the yellow ink head Y corresponding to the pre-curing irradiation section 42*d*, in addition to the dots previously formed on the medium.

Further, for example, the dots formed by the black ink head K undergo UV irradiation for the pre-curing from the pre-curing irradiation sections 42*a* to 42*d* four times until the clear ink is applied. On the other hand, the dots formed by the yellow ink head Y located on the most downstream side in the transport direction among the color ink heads undergo UV irradiation for the pre-curing from the pre-curing irradiation section 42*d* only one time until the clear ink is applied. Thus, the dots formed by the yellow ink head Y has a risk that the curing rate of the pre-curing is low, compared with the dots formed by other color ink heads.

Accordingly, in this way, as the UV irradiation energy of the pre-curing irradiation section 42*d* corresponding to the head located on the most downstream side in the transport direction among the heads for ejecting the color inks becomes large, blurring between the color inks and the clear ink can be effectively restricted.

As going from the upstream side to the downstream side in the transport direction, the irradiation energies of the pre-curing irradiation sections may be gradually set to increase. That is, the irradiation energies may increase in the order of the pre-curing irradiation section 42*a*, the pre-curing irradiation section 42*b*, the pre-curing irradiation section 42*c*, and the pre-curing irradiation section 42*d*.

Second Modified Example of First Embodiment

In this embodiment, the four colors of color inks (cyan, magenta, yellow and black) are used, but the easiness levels of the curing of the color inks are different from each other with respect to the respective colors. Accordingly, the UV irradiation energy of the pre-curing irradiation section corresponding to the head having a specific color may be changed.

For example, the black ink is hardly cured, compared with the other color inks. Thus, in a case where the coating is performed, the UV irradiation energy of the pre-curing irradiation section 42*a* corresponding to the black ink head K may be set to be large. In this way, the dots formed by the black ink can be further cured by the pre-curing UV irradiation, and thus, blurring can be effectively restricted.

Second Embodiment

In the above described embodiment, the line printer is used as the printing apparatus, but in the second embodiment, a printer (a so-called "serial printer") is used as the printing apparatus, which prints an image on a medium by alternately performing a transport operation in which the medium is transported in the transport direction and a dot forming operation in which the ink is ejected from the head to form the dots while moving the head in a direction (hereinafter, referred to as the "movement direction") intersecting with the transport direction. In the serial printer according to the second embodiment, as described later, nozzle arrays which eject a clear ink on opposite sides (outside) of the nozzle arrays of the plurality of color inks is installed.

Figure 7:
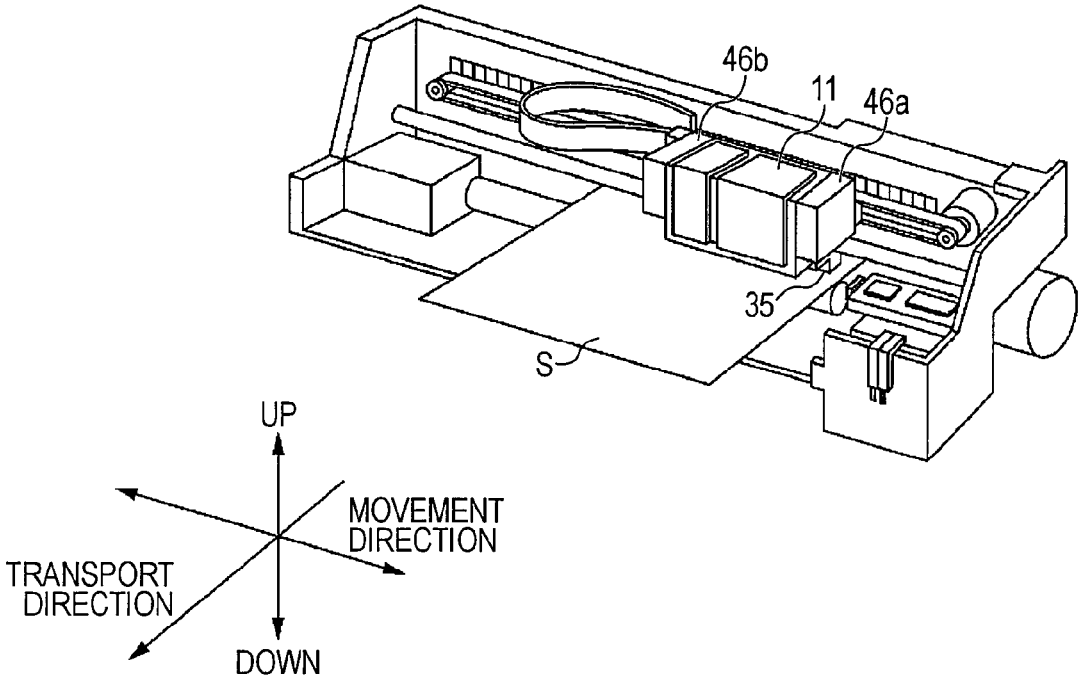
FIG. 7 is a perspective view illustrating a printer according to a second embodiment of the invention.
Figure 8:
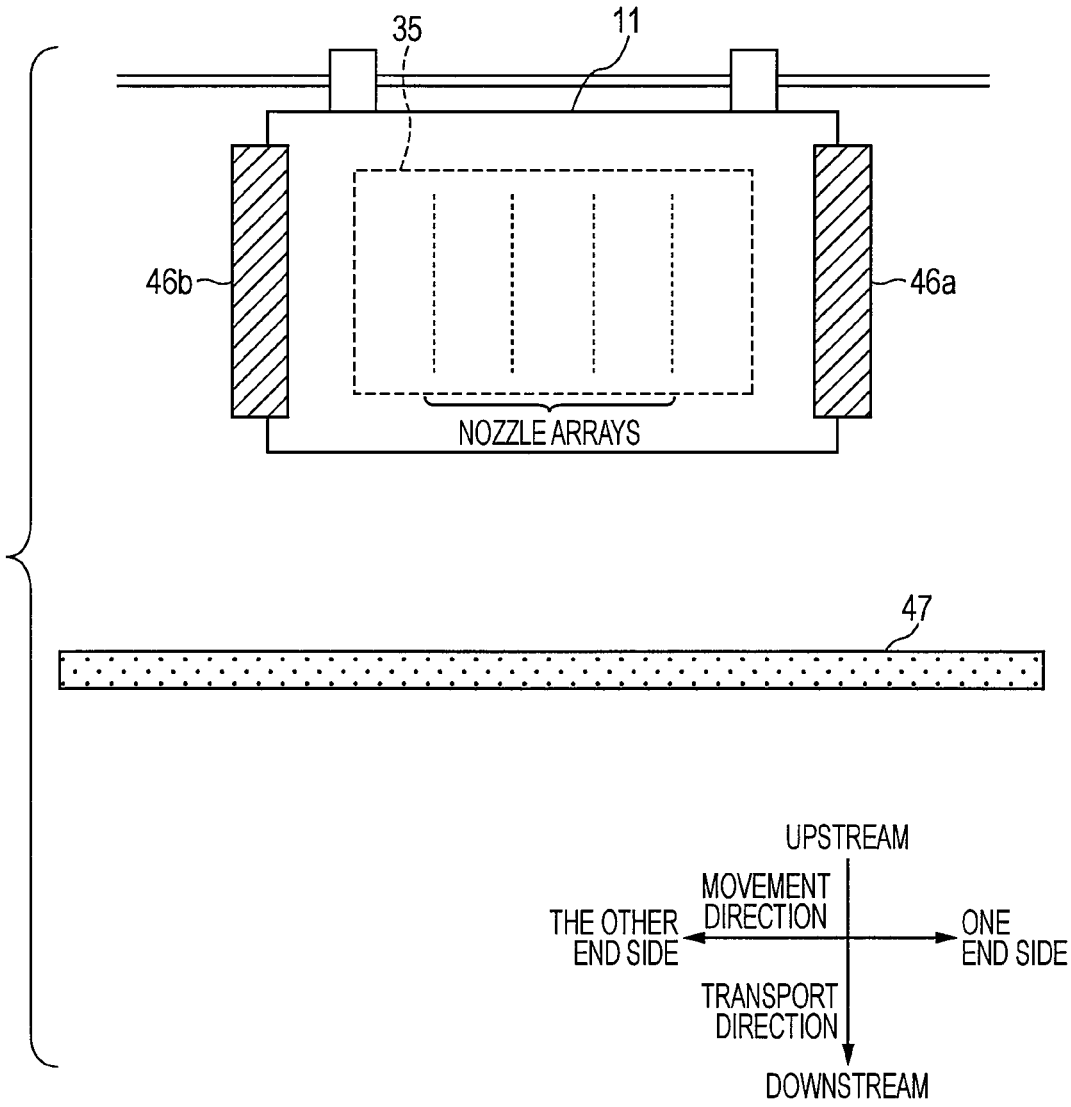
FIG. 8 is a schematic diagram illustrating a periphery of a head of the printer according to the second embodiment of the invention.

FIG. 7 is a perspective view illustrating the printer (serial printer) according to the second embodiment, and FIG. 8 is a schematic diagram of a periphery of a head of the printer according to the second embodiment.

The serial printer shown in FIGS. 7 and 8 includes a carriage 11, a head 35, pre-curing irradiation sections 46*a* and 46*b*, and a main-curing irradiation section 47.

The carriage 11 can reciprocatingly move in the movement direction, and is driven by a carriage motor (not shown). Further, the carriage 11 holds an ink cartridge for containing ink to be able to be detached.

The head 35 includes a plurality of nozzles which ejects UV ink, and is installed in the carriage 11. Thus, if the carriage 11 moves in the movement direction, the head 35 also moves in the movement direction. Further, as the head 35 intermittently ejects ink during movement in the movement direction, dot lines (raster lines) are formed on the medium along the movement direction.

The pre-curing irradiation sections 46*a* and 46*b* are used for pre-curing the dots formed on the medium, and are installed on opposite sides of the carriage 11 in the movement direction, respectively so that the head 35 is disposed between them. Accordingly, if the carriage 11 moves in the movement direction, the pre-curing irradiation sections 46*a* and 46*b* also moves in the movement direction and ejects the pre-curing UV toward the medium.

The main-curing irradiation section 47 is used for main-curing the dots after the pre-curing, and is installed over the length which is equal to or larger than the width of the medium on the downstream side (for example, a position right before paper discharge) in the transport direction with respect to a printing region. In a similar way to the above described embodiment, the main-curing irradiation section 47 includes a lamp as a light source of UV irradiation.

A Configuration of the Head According to the Second Embodiment

Figure 9:
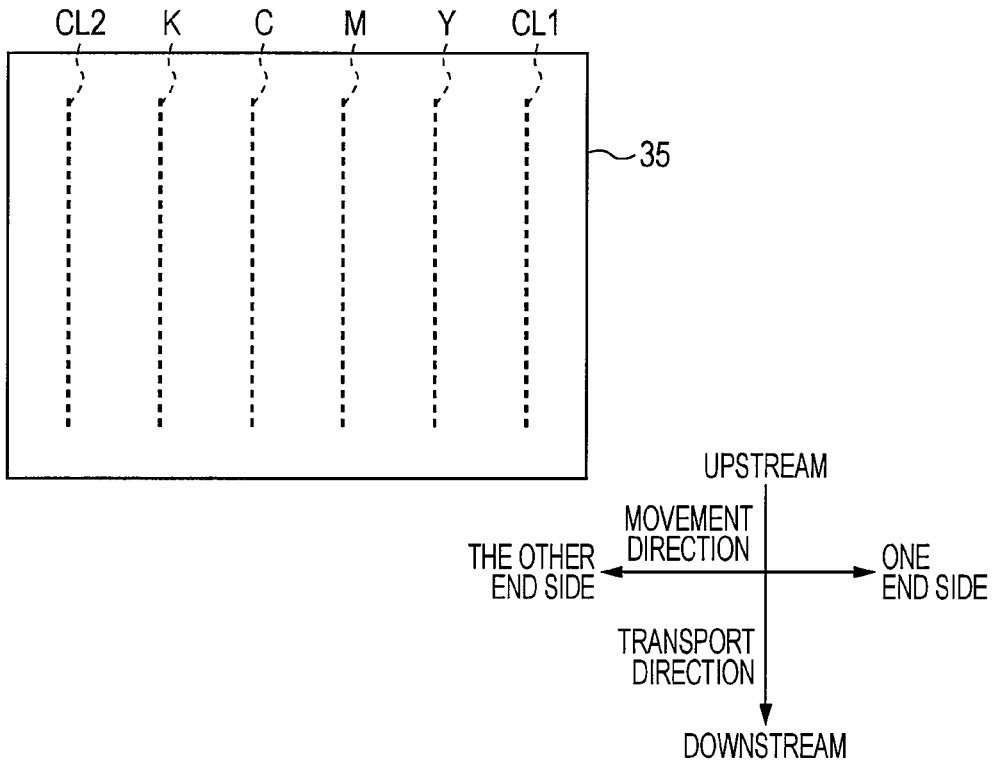
FIG. 9 is a diagram illustrating a configuration of the head according to the second embodiment of the invention.

FIG. 9 is a diagram illustrating a configuration of the head 35 according to the second embodiment. In the lower surface of the head 35, as shown in FIG. 9, as the nozzle arrays for the color links, a black ink nozzle array K, a cyan ink nozzle array C, a magenta ink nozzle array M and a yellow ink nozzle array Y are sequentially arranged from one end side of the movement direction to the other end side thereof.

Further, clear ink nozzle arrays are installed on opposite sides of the nozzle arrays for the color inks. Specifically, a first clear ink nozzle array CL1 is installed on one end side in the movement direction with respect to the yellow ink nozzle array Y, and a second clear ink nozzle array CL2 is installed in the other end side in the movement direction with respect to the black ink nozzle array K. As the two nozzle arrays of the clear ink are provided in this way, the amount of the ink ejected in the onetime dot forming operation becomes large.

In each of the nozzle arrays, a plurality of nozzle arrays (for example, 180) for ejecting the UV ink is arranged with a predetermined nozzle pitch in the transport direction. Further, a piezo-element (not shown) as a driving element for ejecting the UV ink from each nozzle is installed in the nozzle of each nozzle array. As the piezo-element is driven by a driving signal, the UV ink of a droplet shape from each nozzle is ejected. The ejected UV ink is landed onto the medium so as to form dots.

Printing Operation According to the Second Embodiment

In the printer according to the second embodiment, a dot forming operation in which the UV ink is ejected from the nozzles of the head 35 during movement in the movement direction to form dots and a transport operation in which the medium is transported in the transport direction are repeated, and thus, an image formed by a plurality of dots is printed on the medium.

FIGS. 10A to 10E are diagrams illustrating a printing operation according to the second embodiment. In the figures, a pre-curing irradiation section, which is to be used among the pre-curing irradiation sections 46*a* and 46*b*, is indicated by a slanted line. Here, a printing operation in a case where the coating is performed is shown.

Figure 10A:
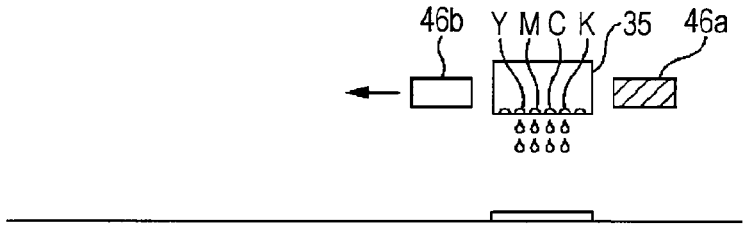
FIG. 10A is a diagram illustrating a printing operation according to the second embodiment of the invention.

Firstly, in an initial dot forming operation, the controller 60 makes the UV ink to be ejected from the color ink nozzle arrays (black ink nozzle array K, cyan ink nozzle array C, magenta ink nozzle array M, and yellow ink nozzle array Y) of the head 35 while moving the carriage 11 from one end side of the movement direction to the other end side thereof (hereinafter, referred to as the "forward direction"). Thus, as shown in FIG. 10A, the color inks are landed on the medium to form dots (color dots).

Figure 10B:
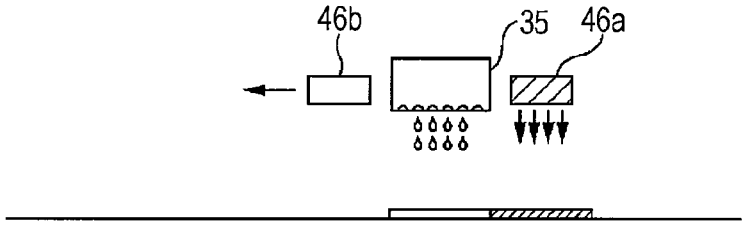
FIG. 10B is a diagram illustrating a printing operation according to the second embodiment of the invention.

Further, the controller 60 moves the carriage 11 in the forward direction. Since the pre-curing irradiation section 46*a* is positioned on the upstream side (one end side) of the head 35 in the movement direction, as shown in FIG. 10B, the pre-curing irradiation section 46*a* passes over the color dots right after being formed in FIG. 10A. At this time, the controller 60 makes the pre-curing UV to be emitted from the pre-curing irradiation section 46*a*. In this way, at a timing right after forming the dots by the color inks, the pre-curing is performed.

Further, in FIG. 10B, the controller 60 makes the UV ink to be ejected from the color ink nozzle arrays of the head 35. Thus, as shown in FIG. 10B, in a region facing the head 35, the dots by the color inks are in a state of immediately being formed (not pre-cured), and in a region facing the pre-curing irradiation section 46*a*, the dots by the color inks is in a state of being pre-cured.

Figure 10C:
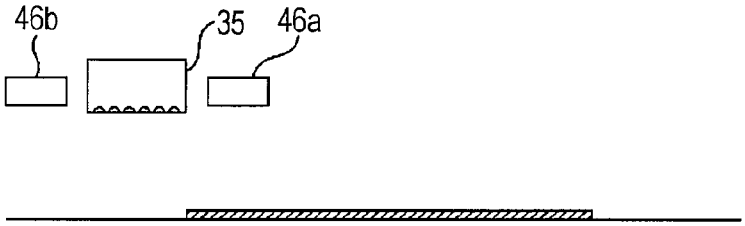
FIG. 10C is a diagram illustrating a printing operation according to the second embodiment of the invention.

In this way, if the carriage 11 moves to the other end side in the movement direction, as shown in FIG. 10*c*, the color image (image after the pre-curing) by the four colors of color inks is formed on the medium.

Figure 10D:
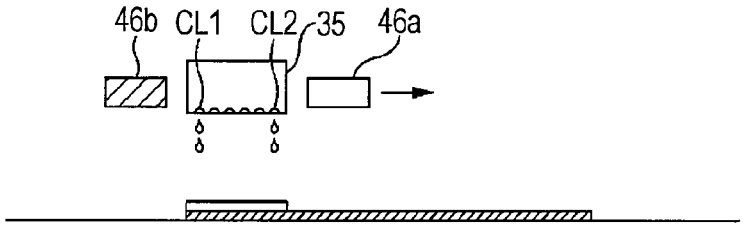
FIG. 10D is a diagram illustrating a printing operation according to the second embodiment of the invention.

Next, the controller 60 makes the UV ink be ejected from the nozzle arrays (the first clear ink nozzle array CL1, and the second clear ink nozzle array CL2) of the clear ink of the head 35, while moving the carriage 11 from the other end side of the movement direction to one end side thereof (hereinafter, referred to as the "backward direction"). Thus, as shown in FIG. 10D, the clear ink is landed on the medium over the image formed by the color inks so as to form the clear dots.

Figure 10E:
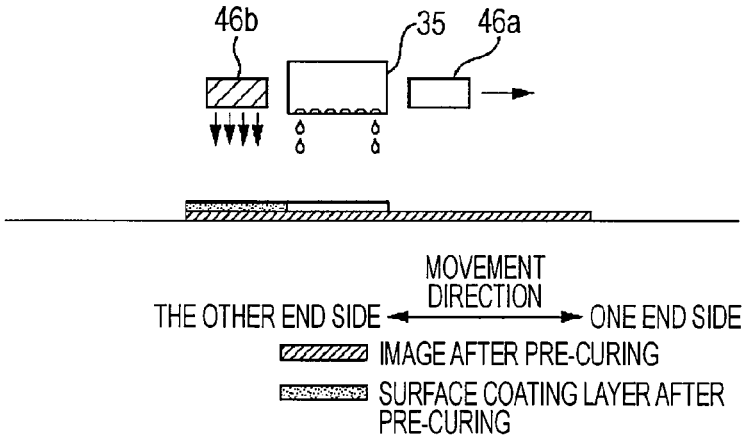
FIG. 10E is a diagram illustrating a printing operation according to the second embodiment of the invention.

Further, the controller 60 moves the carriage 11 in the backward direction. In this case, since the pre-curing irradiation section 46*b* is positioned on the upstream side (other end side) of the head 35 in the movement direction, as shown in FIG. 10E, the pre-curing irradiation section 46*b* passes over the dots (clear dots) right after being formed in FIG. 10D. At this time, the controller 60 makes the pre-curing UV be emitted from the pre-curing irradiation section 46*b*.

Further, in FIG. 10E, the controller 60 makes the clear ink be ejected from the nozzle arrays (CL1 and CL2) of the clear ink of the head 35. Thus, as shown in FIG. 10E, in a region facing the head 35, the clear dots by the clear ink are in a state of immediately being formed (not pre-cured), and in a region facing the pre-curing irradiation section 46*b*, the clear dots by the clear ink is in a state of being pre-cured.

In a similar way to the above described embodiment, the irradiation energy of the pre-curing UV emitted to the clear dots may be small. Alternatively, the pre-curing UV may not be emitted to the clear dots. Further, in order to increase the clear ink ejected on the color image, in this embodiment, the two nozzle arrays for ejecting the clear ink are provided, but one nozzle array for ejecting the clear ink may be provided.

In this way, if the carriage 11 returns to one end side in the movement direction, the color image printed by the color inks is formed on the medium, and a surface coating layer formed by the clear ink is formed on the color image.

After the carriage 11 reciprocates in the movement direction one time, the controller 60 transports the medium in transport direction by a predetermined amount (transport operation). Then, the controller 60 alternately performs the dot forming operation and the transport operation as described above. Further, before the medium is discharged, the controller 60 makes the main-curing UV be emitted to the medium from the main-curing irradiation section 47 as shown in FIG. 8. Thus, the dots on the medium are completely cured.

Hereinbefore, the case where the coating is performed on the color image is described. However, in the case where the coating is not performed, when the carriage 11 is moved in the backward direction, the ejection of the clear ink from the nozzle arrays (CL1 and CL2) of the clear ink and UV irradiation from the pre-curing irradiation section 42*b* may not be performed.

Figure 11:
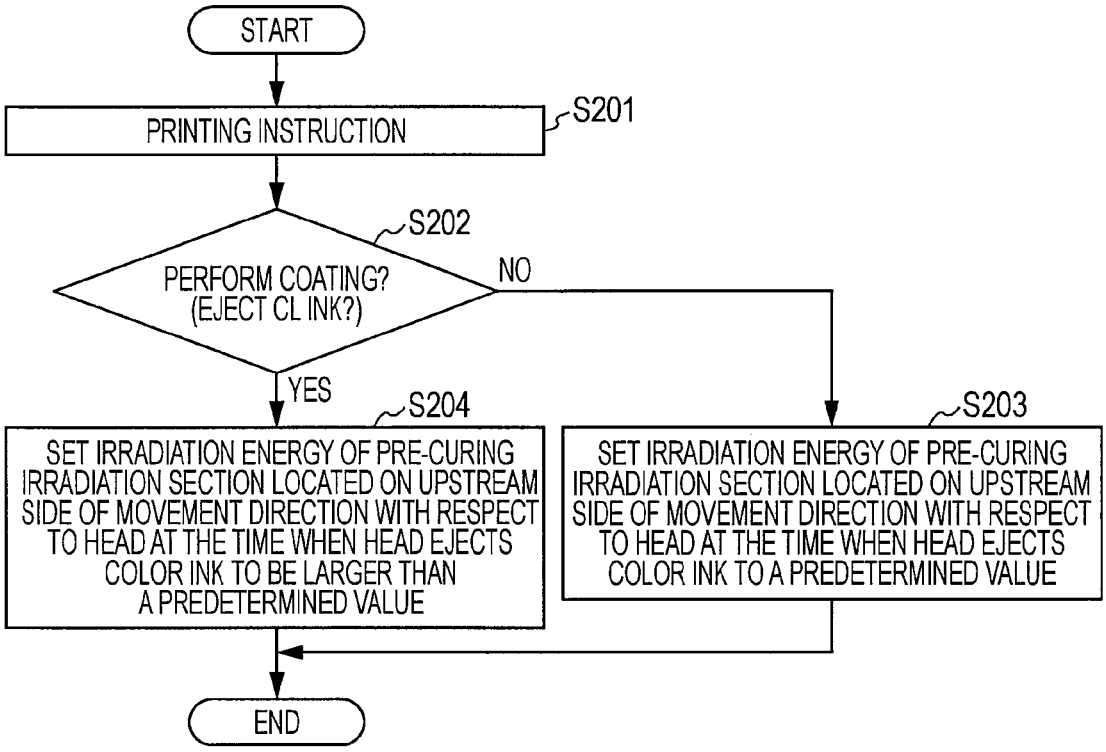
FIG. 11 is a flowchart illustrating UV irradiation energy setting of pre-curing according to the second embodiment of the invention.

FIG. 11 is a flowchart illustrating an irradiation energy setting of the pre-curing UV according to the second embodiment.

Firstly, if the controller 60 receives a printing instruction from the computer 110 (S201), and determines whether the coating is to be performed (that is, whether the clear ink is to be ejected from the first clear ink nozzle CL1 and the second clear ink nozzle CL2) (S202). In a case where it is determined that the coating is not to be performed ("NO" in S202), the UV irradiation energy of the pre-curing irradiation section (the pre-curing irradiation section 46*a* in FIG. 10B) located on the upstream side of the movement direction with respect to the head 35 at the time when the head 35 ejects the color inks is set to be a predetermined value.

On the other hand, in the case where it is determined that the coating is to be performed ("YES" in S202), the UV irradiation energy of the pre-curing irradiation section (the pre-curing irradiation section 46*a* in FIG. 10B) located on the upstream side in the movement direction with respect to the head 35 at the time when the head 35 ejects the color inks is set to be larger than the predetermined value. In other words, the input electric current to the light source (LED) of the pre-curing irradiation section 46*a* is set to be larger than the input electric current in the case where the coating is not performed.

In this way, in the printer according to the second embodiment, according to whether the coating is performed after the color image is formed by the color inks, the irradiation energy of the pre-curing UV to the color dots is changed. Specifically, the UV irradiation energy of the pre-curing irradiation section 46*a* for emitting the UV the color dots is set to be large in the case where the coating is present, compared with the case where the coating is not present. In this way, blurring can be restricted in the case where the coating is performed on the color image.

Other Embodiments

Hereinbefore, the printer or the like is described as the embodiments. The above described embodiments are described for clarity of the present invention, and should not be interpreted to limit the invention. The invention may be modified or improved without departing from the spirit of the invention, and may include equivalents thereof. In particular, embodiments to be described hereinafter are included in the invention.

Printer

In the above described embodiments, the printer is described as an example of the apparatus, but the apparatus is not limited thereto. For example, the same technique as in the present embodiment may be applied to a variety of printing apparatuses, such as a color filter manufacturing apparatus, a dyeing apparatus, a micro-fabricating apparatus, a semiconductor manufacturing apparatus, a surface processing apparatus, a three-dimensional modeling apparatus, a liquid vaporization apparatus, an organic EL manufacturing apparatus (particularly, a polymer EL manufacturing apparatus), a display manufacturing apparatus, a coating equipment, a DNA chip manufacturing apparatus or the like, which employs the ink jet technique.

Ink (1)

In the above described embodiments, the ink (UV ink) cured by the irradiation of the ultraviolet light (UV) is emitted from the nozzles. However, the liquid ejected from the nozzles is not limited to such an ink, and the liquid cured by the irradiation of light (for example, visible light) other than UV may be ejected from the nozzles. In this case, the light (visible light or the like) for curing the liquid may be emitted from the pre-curing irradiation section and the main-curing irradiation section.

Ink (2)

In the above described embodiments, the colorless and transparent clear ink is used for coating the image, but the present invention is not limited to the clear ink. For example, a translucent ink having glazing properties on the surface of the medium may be used.

Further, for example, an image (color image) when seen from the side of the medium may be printed on a transparent medium (reverse printing mode), and a background image may be printed by a background ink (for example, white ink) after the color image printing. This case can be also applied to the above described embodiments. For example, in the reverse printing mode, in a case where the background image is printed, blurring between the color image and the background image may occur. Accordingly, in the case where the background image is printed, the irradiation energy of the pre-curing UV emitted onto the color dots may be set to be larger than in the case where the background image is not printed. Thus, even though the background image is printed on the color image, blurring can be restricted.

Pre-Curing Irradiation Energy

In the above described embodiments, in the case where the surface of the color image is coated, the irradiation energy of the pre-curing UV emitted to the color dots is set to be large. In this way, blurring between the inks is restricted. Here, in this case, blurring is restricted, but the unevenness of the color image surface due to the color dots becomes increased, and thus, the glazing deteriorats.

However, depending on individual preferences of a user, an image in which blurring may be allowed in consideration of the glazing (or blurring is intentionally performed) may be printed. In this case, when the coating is performed, the irradiation energy of the pre-curing UV emitted to the color dots may be set to be small. Thus, an image having blurring and the enhanced glazing can be printed.

The entire disclosure of Japanese Patent Application No. 2009-236568, filed Oct. 13, 2009 is expressly incorporated by reference herein.

What is claimed is:

1. A printing apparatus comprising:

a first nozzle which ejects a first ink used to print an image on a medium and cured by irradiation of light;

a pre-curing light source which emits a pre-curing light to dots formed as the first ink ejected from the first nozzle lands onto the medium;

a second nozzle which ejects a second ink used to coat a surface of the medium and cured by irradiation of light onto the medium after the dots formed by the first ink are irradiated by the light from the pre-curing light source; and a main-curing light source which emits a main-curing light to the medium, wherein irradiation energy of the light emitted to a unit area of the medium from the pre-curing light source in a case where the second ink is ejected from the second nozzle is larger than the irradiation energy of the light emitted from the pre-curing light source in a case where the second ink is not ejected from the second nozzle.

2. The printing apparatus according to claim 1, wherein the first ink includes color inks, wherein the plurality of first nozzles is aligned in a transport direction of the medium for every color of the color inks, and wherein the plurality of pre-curing light sources is installed, corresponding to the plurality of first nozzles, respectively.

3. The printing apparatus according to claim 2, wherein the irradiation energy of the light from each pre-curing light source is changed according to whether the second ink is ejected from the second nozzle.

4. The printing apparatus according to claim 2, wherein the irradiation energy of the light from the pre-curing light source corresponding to the first nozzle located on the most downstream side in the transport direction is changed according to whether the second ink is ejected from the second nozzle.

5. The printing apparatus according to claim 2, wherein the irradiation energy of the light from the pre-curing light source corresponding to a predetermined first nozzle is changed according to whether the second ink is ejected from the second nozzle.

6. The printing apparatus according to claim 1, wherein the second ink is a clear ink.

7. The printing apparatus according to claim 1, wherein the second ink is a background ink for printing a background image of the image.

8. The printing apparatus according to claim 1, further comprising a controller that changes the irradiation energy of the light emitted from the pre-curing light source;

wherein the controller sets the irradiation energy of the light emitted to a unit area of the medium from the pre-curing light source to a first predetermined value when the second ink is not ejected from the second nozzle, and the controller sets the irradiation energy of the light emitted to a unit area of the medium from the pre-curing light source to a second predetermined value that is different from the first predetermined value when the second ink is ejected from the second nozzle.

9. A printing method using a printing apparatus which includes: a first nozzle which ejects a first ink used to print an image on a medium and cured by irradiation of light; a pre-curing light source which emits pre-curing light to dots formed as the first ink ejected from the first nozzle lands onto the medium; a second nozzle which ejects a second ink used to coat a surface of the medium and cured by irradiation of light onto the medium after being irradiated by the light emitted from the pre-curing light source; and a main-curing light source which emits main-curing light to the medium, the method comprising:

enlarging irradiation energy of the light emitted to a unit area of the medium from the pre-curing light source in a case where the second ink is ejected from the second nozzle as compared to the irradiation energy of the light emitted from the pre-curing light source in a case where the second ink is not ejected from the second nozzle; and emitting the light from the pre-curing light source to the dots formed as the first ink lands onto the medium.

10. A printing method using a printing apparatus which includes: a plurality of first nozzles which eject a plurality of first inks used to print an image on a medium and cured by irradiation of light; a plurality of pre-curing light sources, corresponding to the plurality of first nozzles, which each emit pre-curing light to dots formed as the first inks ejected from the first nozzles land onto the medium, and at least one of which emits pre-curing light having an irradiation energy per unit area that is different from irradiation energies per unit area of the remaining pre-curing light sources, and; a second nozzle which ejects a second ink used to coat a surface of the medium and cured by irradiation of light onto the medium after being irradiated by the light emitted from the pre-curing light sources; and a main-curing light source which emits main-curing light to the medium, the method comprising:

changing the irradiation energies of the light emitted to a unit area of the medium from each of the pre-curing light sources according to whether the second ink is ejected from the second nozzle; and emitting the light from the pre-curing light sources to the dots formed as the first inks land onto the medium.

11. The printing method of claim 10, wherein the irradiation energies of the light emitted to a unit area of the medium increase from a downstream side to an upstream side of a transport direction of the medium.

* * * * *